US007796004B2

(12) United States Patent
Matsubayashi et al.

(10) Patent No.: US 7,796,004 B2
(45) Date of Patent: Sep. 14, 2010

(54) IGNITION COIL

(75) Inventors: Shuichi Matsubayashi, Tsurugashima (JP); Ikuo Hirayama, Tsurugashima (JP); Masami Kojima, Chiryu (JP); Takashi Tauchi, Nagoya (JP)

(73) Assignees: Toyo Denso Kabushiki Kaisha, Tokyo (JP); Denso Corporation, Kariya (JP)

( * ) Notice: Subject to any disclaimer, the term of this patent is extended or adjusted under 35 U.S.C. 154(b) by 92 days.

(21) Appl. No.: 12/150,159

(22) Filed: Apr. 25, 2008

(65) Prior Publication Data

US 2008/0264396 A1 Oct. 30, 2008

(30) Foreign Application Priority Data

Apr. 27, 2007 (JP) ..... 2007-119212

(51) Int. Cl.

| | |
|---|---|
| ***H01F 27/02*** | (2006.01) |
| ***H01F 21/04*** | (2006.01) |
| ***H01F 17/06*** | (2006.01) |
| ***H01F 27/30*** | (2006.01) |
| ***H01F 38/12*** | (2006.01) |
| ***F02P 3/02*** | (2006.01) |

(52) U.S. Cl. ..... 336/90; 336/92; 336/96; 336/115; 336/178; 336/198; 123/634; 123/635

(58) Field of Classification Search ..... 336/90, 336/92, 96, 115, 178, 198; 123/634, 635
See application file for complete search history.

(56) References Cited

U.S. PATENT DOCUMENTS

| | | | | |
|---|---|---|---|---|
| 4,216,755 | A * | 8/1980 | Ordines | 123/643 |
| 5,146,905 | A * | 9/1992 | Davis | 123/599 |
| 6,281,682 | B1 * | 8/2001 | Kameda et al. | 324/391 |
| 6,860,256 | B2 * | 3/2005 | Nakamura et al. | 123/621 |

FOREIGN PATENT DOCUMENTS

| | | |
|---|---|---|
| JP | 57-051960 | 3/1982 |
| JP | 59-13853 | 1/1984 |
| JP | 61034912 A * | 2/1986 |
| JP | 2004-247571 | 9/2004 |

* cited by examiner

*Primary Examiner*—Elvin G Enad
*Assistant Examiner*—Tszfung Chan
(74) *Attorney, Agent, or Firm*—Cohen Pontani Lieberman & Pavane LLP

(57) ABSTRACT

An ignition coil of a dual ignition type that can prevent outputs from becoming unbalanced due to a difference in floating capacitance on wiring that connects secondary output terminals and ignition plugs together, thus realizing balanced outputs. A coil assembly housed in a housing as a coil case has a primary coil and secondary coils disposed concentrically with the primary coil. The secondary coils are comprised of two coils wound in opposite directions with the center of winding width being a boundary. The center of the winding width of the primary coil is shifted from the center of the winding width of the secondary coils by a predetermined width so as to balance outputs from the two secondary coils. A casting material is filled into a gap between the housing and the coil assembly and gaps which the coil assembly has.

7 Claims, 12 Drawing Sheets

IGNITION COIL

BACKGROUND OF THE INVENTION

1. Field of the Invention

The present invention relates to an ignition coil of a dual ignition type that is applied to a cylinder having two ignition plugs, and in particular to an ignition coil that has an output terminal mounted on a plug hole of an engine and directly connected to one ignition plug, and an output terminal connected to the other ignition plug in the same cylinder via a high tension cord.

2. Description of the Related Art

In internal combustion engines such as vehicle engines, an ignition coil and an ignition plug are used as, for example, detonators that burn gasoline as fuel.

As an example of an ignition coil, there is known an ignition coil of a dual ignition type that is applied to a cylinder having two ignition plugs.

Examples of publications of prior arts relating to an ignition coil of a dual ignition type, a diagnostic apparatus therefor, or the like include Japanese Examined Patent Publication (Kokoku) No. S63-28238, Japanese Laid-Open Patent Publication (Kokai) No. 2004-247571, and Japanese Laid-Open Utility Model Publication (kokai) No. S59-13853.

In Japanese Examined Patent Publication (Kokoku) No. S63-28238, a diagnostic apparatus that makes a diagnosis as to the floating capacitance and the igniting ability of an ignition coil of a dual ignition type is described.

In Japanese Laid-Open Patent Publication (Kokai) No. 2004-247571, a conventional ignition coil of a dual ignition type is described. FIG. 14 is a connection wiring diagram showing the ignition coil described in Japanese Laid-Open Patent Publication (Kokai) No. 2004-247571. As shown in FIG. 14, a primary coil 281 and secondary coils 282 face each other with a predetermined space left therebetween, and the secondary coils 282 are comprised of two secondary coils 282*a* and 282*b* wound in opposite directions (reversely wound) with a center tap 283 being a boundary. The center tap 283, which is the center of the winding width of the secondary coils 282, is connected to one end of the primary coil 281 by wiring 284.

According to this ignition coil of the dual ignition type, outputs of the same polarity are obtained from two secondary output terminals, insulation load in the ignition coil can be reduced, and hence insulation performance can be made stable.

FIG. 15 is a connection wiring diagram showing a conventional ignition coil disclosed in Japanese Laid-Open Utility Model Publication (kokai) No. S59-13853. As shown in FIG. 15, the ignition coil is constructed such that primary coils comprised of a first primary coil and a second primary coil connected in parallel to each other face a secondary coil. That is, the ignition coil is comprised mainly of the primary coils constructed by connecting the first primary coil 291 and the second primary coil 292 in parallel to each other, and the secondary coil 293 disposed such as to face the primary coils with a predetermined space left therebetween.

However, according to the conventional ignition coil of the dual ignition type, outputs from the two secondary output terminals tend to be different due to a difference in the layout of the ignition plugs. Specifically, in the case where one of the secondary output terminals is directly connected to one ignition plug, and the other one of the secondary output terminals is connected to the other ignition plug in the same cylinder via a high tension cord, outputs tend to become unbalanced due to a difference in floating capacitance on wiring extending from the secondary output terminals to the ignition plugs.

Also, the ignition coil of the dual ignition type shown in FIG. 14 has the problem that secondary output in a low-speed range is unlikely to be stable, and the ignition coil shown in FIG. 15 has the problem that interference of the primary coils occurs due to back electromotive force, resulting in output from the secondary coils decreasing. Thus, if the primary coils comprised of the parallel-connected two coils as shown in FIG. 15 are applied to the ignition coil of the dual ignition type, predetermined high-voltage outputs cannot be applied to the two secondary output terminals, and this will bring about a great loss of output from an engine as a whole.

SUMMARY OF THE INVENTION

The present invention provides an ignition coil of a dual ignition type that can prevent outputs from becoming unbalanced due to a difference in floating capacitance on wiring that connects secondary output terminals and ignition plugs together, thus realizing balanced outputs.

Also, the present invention provides an ignition coil of which output from secondary coils is stable, and in particular an ignition coil of a dual ignition type that can prevent interference of parallel-connected primary coils and thus prevent a decrease in output in a low-speed range and obtain stable output.

Accordingly, in a first aspect of the present invention, there is provided an ignition coil of a dual ignition type comprising a coil case, a coil assembly housed in the coil case, and a casting material filled into a gap between the coil case and the coil assembly and gaps which the coil assembly has, wherein the coil assembly has a coil pair comprising a primary coil and secondary coils disposed concentrically with the primary coils, the secondary coils of the coil pair comprise two coils wound in opposite directions with a center of winding width being a boundary, a center of winding width of the primary coil is shifted from the center of winding width of the secondary coils by a predetermined width so as to balance outputs from the two secondary coils.

According to the first aspect of the present invention, because the center of the winding width of the primary coil is shifted from the center of the winding width of the secondary coils comprised of two coils by a predetermined width, the center of the winding width of the primary coil is shifted, for example, toward one of the secondary coils connected to wiring with high floating capacitance, and hence the binding coefficient of one secondary coil and the primary coil becomes greater than the binding coefficient of the other secondary coil and the primary coil. As a result, a difference in potential at junctions between the two secondary coils and the ignition plugs due to a difference in floating capacitance can be eliminated, so that outputs can be balanced.

The first aspect of the present invention can provide an ignition coil, wherein an output end of one of the secondary coils is directly connected to one ignition plug, and an output end of the other one of the two secondary coils is connected to the other ignition plug in the same cylinder via a high tension cord, and the center of winding width of the primary coil is shifted by a predetermined width toward the secondary coil connected to the other ignition plug in the same cylinder via the high tension cord.

According to the first aspect of the present invention, because in the ignition coil that has the secondary coil directly connected to one ignition plug, and the secondary coil connected to the other ignition plug in the same cylinder via the high tension cord, the center of the winding width of the primary coil is shifted by a predetermined width toward the secondary coil connected to the other ignition plug in the same cylinder via the high tension cord, the binding coefficient of this secondary coil and the primary coil becomes greater than the binding coefficient of the secondary coil directly connected to the ignition plug and the primary coil, and hence a decrease in output caused by the floating capacitance of the high tension cord can be compensated for, and two secondary outputs can be balanced.

The first aspect of the present invention can provide an ignition coil, wherein the shifting width is 1.5 mm to 3.0 mm.

According to the first aspect of the present invention, because the shifting width is 1.5 mm to 3.0 mm, the coil binding coefficient can be set such as to increase output by an amount corresponding to an output required to compensate for a decrease in output due to a difference in floating capacitance, and hence two secondary outputs can be balanced to a satisfactory level.

The first aspect of the present invention can provide an ignition coil, wherein a terminal is provided at the center of winding width of the secondary coils and connected to a positive electrode or a ground of a battery.

According to the first aspect of the present invention, because the terminal provided at the center of the winding width of the secondary coils is connected to the positive electrode or the ground of the battery, stable secondary output can be obtained while reliably maintaining the center of the secondary coils at a low potential.

The first aspect of the present invention can provide an ignition coil, wherein the terminal at the center of winding width of the secondary coils is connected to an anode of a diode, and a cathode of the diode is connected to the positive electrode or the ground of the battery.

According to the first aspect of the present invention, because the terminal at the center of the winding width of the secondary coils is connected to the anode of the diode, and the cathode of the diode is connected to the positive electrode or the ground of the battery, electric discharge of the ignition plugs caused by a rise in ON-current flowing through the primary coil for the first time can be prevented at the time of switching of the primary coil.

The first aspect of the present invention can provide an ignition coil, wherein a core that forms a magnetic path is fitted into a central space of the coil pair, the core forms a closed magnetic path having a center core and a side core, and the center core is fitted into the central space of the coil pair.

According to the first aspect of the present invention, because the core fitted into the central space of the coil pair forms the closed magnetic path having the center core and the side core, and the center core is fitted into the central space of the coil pair, a decrease in secondary output can be prevented when output decreases due to an increase in floating capacitance.

The first aspect of the present invention can provide an ignition coil, wherein the casting material comprises insulating resin.

According to the first aspect of the present invention, because insulating resin is used as the casting material, leakage of electric current can be prevented.

The first aspect of the present invention can provide an ignition coil, wherein the primary coil of the coil pair comprises at least two coils that are connected in parallel to each other, and one ends of the at least two primary coils are connected to anodes of respective corresponding diodes, and cathodes of the respective diodes are connected together.

According to the first aspect of the present invention, because the primary coils of the coil pairs are comprised of at least two coils that are connected in parallel to each other, and one ends of the at least two primary coils are connected to the anodes of respective corresponding diodes, and the cathodes of the respective diodes are connected together, it is possible to stabilize secondary output, in particular secondary output in a low-speed range even when the two parallel-connected coils are used as the primary coils.

Accordingly, in a second aspect of the present invention, there is provided an ignition coil of a dual ignition type comprising a coil case, a coil assembly housed in the coil case, and a casting material filled into a gap between the coil case and the coil assembly and gaps which the coil assembly has, wherein the coil assembly has pairs of coils comprising primary coils and secondary coils disposed concentrically with the primary coils, the primary coils of the coil pairs comprise at least two coils connected in parallel to each other, and one ends of the at least two primary coils are connected to anodes of respective corresponding diodes, and cathodes of the respective diodes are connected together, and the secondary coils of the coil pairs comprise two coils wound in opposite directions with a midpoint P being a boundary.

According to the second aspect of the present invention, because the primary coils of the coil pairs are comprised of at least two coils connected in parallel to each other, one ends of the at least two primary coils are connected to the anodes of the respective corresponding diodes, the cathodes of the respective diodes are connected together, and the secondary coils of the coil pairs are comprised of two coils wound in opposite directions with the midpoint P being a boundary, back electromotive force can be prevented from being produced in the primary coils, and hence interference of the primary coils can be prevented. As a result, secondary output, in particular secondary output in a low-speed range can be made stable.

The second aspect of the present invention can provide an ignition coil, wherein a terminal is provided at the midpoint P of the secondary coils and connected to a positive electrode or a ground of a battery.

According to the second aspect of the present invention, because the terminal provided at the midpoint P of the secondary coils is connected to the positive electrode or the ground of the battery, the polarities of electric discharge of secondary outputs can be unified to positive electric discharge or negative electric discharge by selecting the direction in which the primary coils are wound.

The second aspect of the present invention can provide an ignition coil, wherein the terminal at the midpoint P is connected to an anode of a diode other than the diodes connected to the primary coils, and a cathode of the diode of which the terminal is connected to the anode is connected to the positive electrode or the ground of the battery.

According to the second aspect of the present invention, because the terminal provided at the midpoint P of the two secondary coils is connected to the anode of the diode other than the diodes connected to the primary coils, and the cathode of the diode of which the terminal is connected to the anode is connected to the positive electrode or the ground of the battery, electric discharge of the ignition plugs caused by a rise in ON-current flowing through the primary coils for the first time can be prevented at the time of switching of the primary coils.

The second aspect of the present invention can provide an ignition coil, wherein the cathode of the diode of which the terminal is connected to the anode is connected to the cathodes of the diodes connected to the primary coils.

According to the second aspect of the present invention, because the cathode of the diode of which the terminal is connected to the anode is connected to the cathodes of the diodes connected to the primary coils, the cathode of the diode of which the terminal is connected to the anode can be reliably connected to the ground at the time of switching of the primary coils, and hence electric discharge of the ignition plugs caused by a rise in ON-current flowing through the primary coils for the first time can be prevented at the time of switching of the primary coils.

The second aspect of the present invention can provide an ignition coil, wherein ends of the two secondary coils on the midpoint P side are connected to anodes of respective diodes other than the respective corresponding diodes, and the cathodes of the other diodes are connected to the positive electrode or the ground of the battery via the midpoint P.

According to the second aspect of the present invention, because the ends of the two secondary coils on the midpoint P side are connected to the anodes of the other respective corresponding diodes, and the cathodes of these diodes are connected to the positive electrode or the ground of the battery via the midpoint P, electric discharge of the ignition plugs caused by a rise in ON-current flowing through the primary coils for the first time can be prevented at the time of switching of the primary coils.

The second aspect of the present invention can provide an ignition coil, wherein the midpoint P is connected to the cathodes of the diodes connected to the primary coils.

According to the second aspect of the present invention, because the midpoint P is connected to the cathodes of the diodes connected to the primary coils, the midpoint P can be reliably connected to the ground at the time of switching of the primary coils, and hence electric discharge of the ignition plugs caused by a rise in ON-current flowing through the primary coils for the first time can be prevented at the time of switching of the primary coils.

The second aspect of the present invention can provide an ignition coil, wherein a core that forms a magnetic path is fitted into central spaces of the coil pairs, and the primary coils comprise two coils wound in opposite directions, the core is a core that forms a closed magnetic path having center cores and a side core, the center cores comprise at least two rod-shaped core members arranged in series and joined together, and the side core has a side core main body extended parallel to the center cores, and at least three extended portions extending from the side core main body such as to join an upper end, a joint portion, and a lower end, respectively, of the center cores.

According to the second aspect of the present invention, because the primary coils are comprised of two coils wound in opposite directions, magnetic fluxes in different directions can be prevented from colliding with each other in a common magnetic path by constructing the ignition coil such that the primary coils are arranged such as to be linearly adjacent to each other in an axial direction, the center cores of the core are disposed in the centers of the respective coils, and the extended portion as a common magnetic path of the side core (hereinafter sometimes referred to merely as the "common magnetic path") is disposed at the boundary between the adjacent primary coils.

The second aspect of the present invention can provide an ignition coil, wherein a core that forms a magnetic path is fitted into central spaces of the coil pairs, and the primary coils comprise two coils wound in the same direction, the core is a rod-shaped core that forms an open magnetic path in which a plurality of or single I-shaped core member is disposed in a line, or a square-shaped core that forms a closed magnetic path in which an I-shaped core member and a square U-shaped core member are connected together.

According to the second aspect of the present invention, because the primary coils are comprised of two coils wound in the same direction, the core is a rod-shaped core that forms an open magnetic path in which a plurality of or single I-shaped core member is disposed in a line, or a square-shaped core that forms a closed magnetic path in which an I-shaped core member and a square U-shaped core member are connected together, there is no common magnetic path, and hence the dimension (overall length) of the ignition coil in an axial direction can be reduced.

The second aspect of the present invention can provide an ignition coil, wherein the casting material comprises insulating resin.

According to the second aspect of the present invention, because insulating resin is used as the casting material, leakage of electric current can be prevented.

The features and advantages of the invention will become more apparent from the following detailed description taken in conjunction with the accompanying drawings.

DETAILED DESCRIPTION OF THE PREFERRED EMBODIMENTS

A first embodiment of the present invention will now be described in detail with reference to the drawings.

Figure 1:
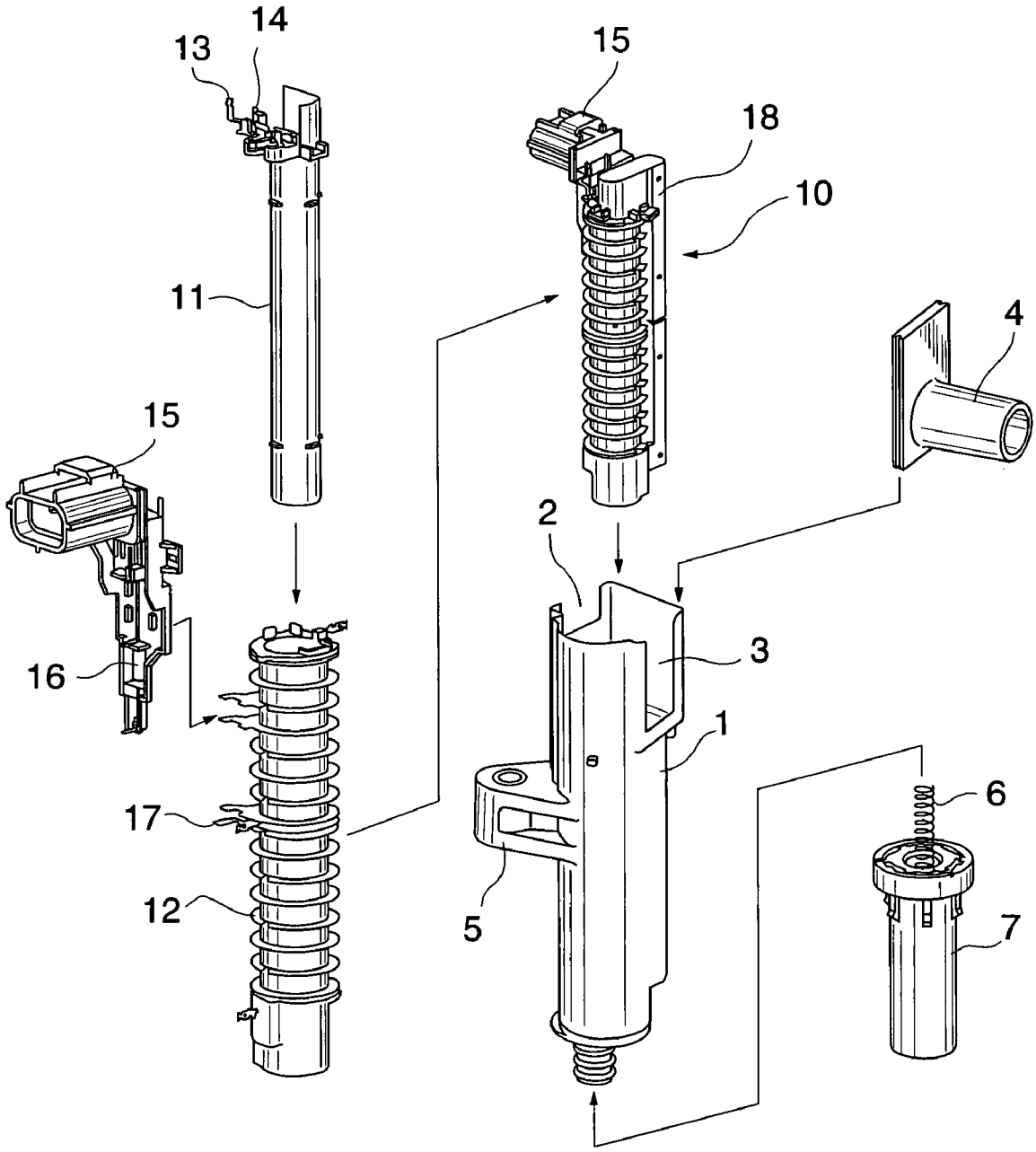
FIG. 1 is an assembly diagram showing an ignition coil according to a first embodiment of the present invention.

FIG. 1 is an assembly diagram showing an ignition coil for an internal combustion engine according to the first embodiment.

As shown in FIG. 1, the ignition coil is of a dual ignition type having two secondary output terminals, and is comprised mainly of a housing 1 as a coil case, and a coil assembly 10 fitted into the housing 1.

The coil assembly 10 is comprised of a substantially cylindrical primary coil bobbin 11 around which a primary coil (not shown) is wound, and a substantially cylindrical secondary coil bobbin 12 around which secondary coils (not shown) are wound and of which diameter is larger than the diameter of the primary coil bobbin 11. The secondary coil bobbin 12 around which the secondary coil is wound is disposed outside and concentrically with the primary coil bobbin 11 around which the primary coil is wound. The primary coil and the secondary coils thus form a pair of coils that are concentrically arranged.

Primary terminals 13 and 14 are forcibly pressed into one end of the primary coil bobbin 11, and the start of winding and the end of winding of the primary coil are connected to the primary terminals 13 and 14, respectively, by fusing or the like. The primary terminals 13 and 14 are inserted into a connector 15 from one end thereof, and the connector 15 is fixed at a predetermined location of the secondary coil bobbin 12.

A center core portion of a core 18 forming a magnetic path is fitted into a central space of the primary coil bobbin 11 along the central axis of the coil pair including the primary coil and the secondary coils that are concentrically arranged, and as a result, the coil assembly 10 comprised mainly of the primary coil, the secondary coils, and the core 18 is constructed.

A cut portion 2 with which the above described connector 15 is to be engaged is provided at an opening end of an upper portion of the housing 1 as a coil case. A cut portion 3 with which an H/T tower 4 as a take-out end for secondary output is to be engaged is provided such as to face the cut portion 2 across the central axis of the housing 1. Moreover, a mounting flange 5 for fixing the ignition coil to an engine block is provided on an outer surface of the housing 1, and a plug cap 7 having a spring 6 therein is engaged with a lower end of the housing 1 as viewed in FIG. 1.

Figure 2:
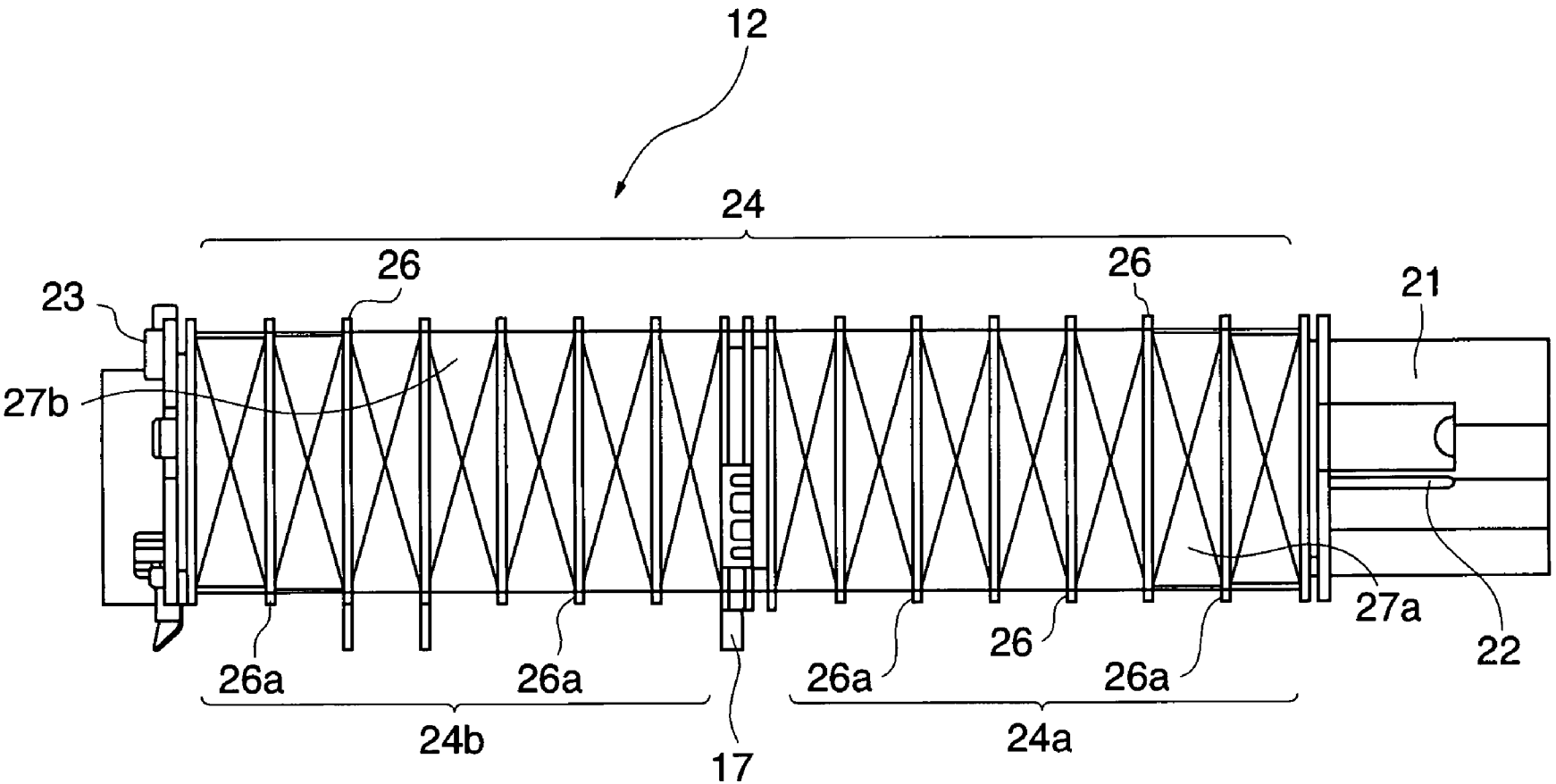
FIG. 2 is a plan view showing a secondary coil bobbin as a constructional member of a coil assembly.

Next, a detailed description will be given of the coil assembly. FIG. 2 is a plan view showing the secondary coil bobbin 12 as a constructional member of the coil assembly.

As shown in FIG. 2, the secondary coil bobbin 12 is comprised mainly of a cylindrical secondary coil bobbin main body 21 made of modified PPO (polyphenylene oxide) resin, and a first secondary output terminal 22 and a second secondary output terminal 23 provided at respective ends of the secondary coil bobbin main body 21 in the longitudinal direction thereof.

An outer surface of the secondary coil bobbin main body 21 is a winding area 24 around which the secondary coils are wound. An intermediate tap 17 as a terminal is provided in substantially the center of the winding width of the winding area 24. The intermediate tap 17 divides the winding area 24 into a first winding area 24*a* and a second winding area 24*b*. Each of the winding areas 24*a* and 24*b* is partitioned, for example, at regular intervals by a plurality of partition plates 26 extended in the direction of the normal to an outer peripheral surface thereof.

Coils are wound in opposite directions (reversely wound) around the first winding area 24*a* and the second winding area 24*b* of the winding area 24 divided by the intermediate tap 17, so that secondary coils 27*a* and 27*b* wound in opposite directions are formed.

Ends of the secondary coils 27*a* and 27*b* on the midsection side of the secondary coil bobbin 12 in the longitudinal direction thereof are connected to the midpoint of the intermediate tap 17 as the terminal. On the other hand, the other end of the first secondary coil 27*a* is connected to the first secondary output terminal 22, and the other end of the second secondary coil 27*b* is connected to the second secondary output terminal 23. The two secondary output terminals 22 and 23 are respectively connected to a terminal directly connected to an ignition plug and a terminal connected to the H/T tower 4 as a secondary high-voltage terminal of the housing 1 via respective plug caps by fitting the coil assembly 10 into the housing 1.

Arbitrary ones (four ones in FIG. 2) of the plurality of partition plates 26 that partition the winding areas 24*a* and 24*b* at regular intervals, for example, the second partition plates and the outermost partition plates as viewed from the intermediate tap 17 in the first winding area 24*a* and the second winding area 24*b* are constructed as ribbed partition plates 26*a* that have on outer peripheral portions thereof projections (not shown) that should be guide ribs for positioning. A limited area in which no guide rib is provided is formed on a surface of the secondary coil bobbin 12 which faces the mounting flange 5 on the outer surface of the housing 1 across the wall of the housing 1 when the coil assembly 10 formed using the secondary coil bobbin 12 constructed as described above is fitted into the housing 1. Thus, cracking caused by distortion at joints of insulating resin, which is a hardened casting material, and guide ribs can be prevented.

Figure 3:
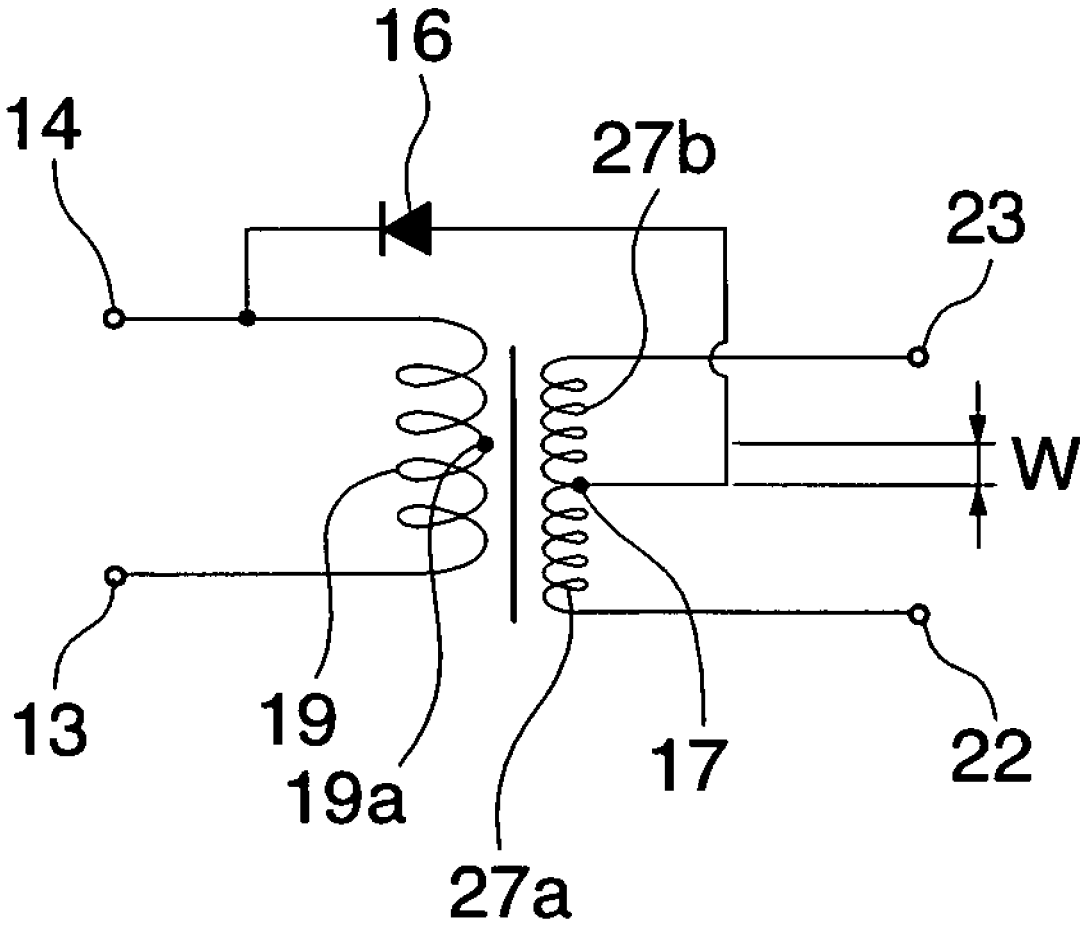
FIG. 3 is a connection wiring diagram showing the coil assembly of the ignition coil according to the first embodiment.

Next, a detailed description will be given of characterized portions of the present embodiment. FIG. 3 is a connection wiring diagram showing the coil assembly according to the present embodiment.

As shown in FIG. 3, the primary coil 19 and the secondary coils 27 (27*a* and 27*b*) face each other with a predetermined space left therebetween. The primary terminal 13 as the start of winding of the primary coil 19 is connected to a control circuit (not shown) that controls the conduction of the primary coil. On the other hand, the primary terminal 14 as the end of winding of the primary coil is connected to the positive (+) side of a battery (not shown). Moreover, the cathode of a diode 16 whose anode is connected to the intermediate tap 17 as the junction of the secondary coils 27*a* and 27*b* is connected to the primary terminal 14. Thus, the intermediate tap 17 of the secondary coils is connected to the positive (+) side of the above-mentioned battery (not shown) via the diode 16 and the primary terminal 14.

An outer end of the secondary coil 27*a* is connected to the secondary output terminal 22, which is directly connected to one ignition plug via a plug cap (not shown). On the other hand, an outer end of the secondary coil 27*b* is connected to the secondary output terminal 23, which is connected to the other ignition plug via an H/T tower and a high tension cord (not shown).

The floating capacitance at the secondary output terminal 23 connected to the ignition plug via the high-tension cord is greater than the floating capacitance at the secondary output terminal 22 directly connected to the ignition plug. It is known that an output voltage from an output terminal with high floating capacitance is lower than an output voltage from an output terminal with low floating capacitance.

Accordingly, to eliminate such an output imbalance, in the present embodiment, the center 19*a* of the winding width of the primary coil 19 is shifted by a predetermined width from the center of the winding width of the secondary coils 27 toward the secondary coil 27*b* connected to the secondary output terminal 23 having high floating capacitance, whereby the binding coefficient Kb of the secondary coil 27*b* and the primary coil 19 is made to be greater than the binding coefficient Ka of the secondary coil 27*a* and the primary coil 19 so as to compensate for a decrease in secondary output resulting from an increase in floating capacitance.

That is, as shown in FIG. 3, the center 19*a* of the winding width of the primary coil 19 is shifted toward the secondary coil 27*b* by, for example, 2 mm (W) from the intermediate tap 17 that is the center of the winding width of the secondary coils 27.

As described above, the secondary coil 27*b* is a coil that is connected to an ignition plug via the secondary output terminal 23 and the high tension cord (not shown), and the floating capacitance thereof increases due to the high tension cord, causing secondary output to decrease. However, by shifting the center 19*a*of the winding width of the primary coil 19 toward the secondary coil 27*b*, the binding coefficient Kb of the secondary coil 27*b* and the primary coil 19 is made to be greater than the binding coefficient Ka of the secondary coil 27*a* and the primary coil 19 to compensate for the decrease in output and balance the two secondary outputs.

In the present embodiment, the shifting width W by which the center 19*a* of the winding width of the primary coil 19 is shifted from the intermediate tap 17, which is the center of the winding width of the secondary coils 27, toward the secondary coil of which floating capacitance increases (for example, the secondary coil 27*b*) is determined as described below.

Specifically, a plurality of ignition coils having different shifting widths W by which the center 19*a* of the winding width of the primary coil 19 is shifted from the intermediate tap 17 that is the center of the winding width the secondary coils 27 are prepared and inserted into cylinders to which they are applied. In this state, the optimum shifting width W that enables two secondary output voltages to match is determined from the plurality of ignition coils.

The shifting width W is determined as described above, and the shifting width W by which the center 19*a*of the winding width of the primary coil 19 is shifted from the intermediate tap 17 of the secondary coils 27 is usually set to 1.5 mm to 3.0 mm. If the shifting width W is less than 1.5 mm, it is impossible to compensate for a decrease in output resulting from an increase in floating capacitance due to the high tension cord, and if the shifting width W is more than 3.0 mm, two outputs are temporarily balanced, and then the output from one secondary coil toward which the center 19*a* of the primary coil 19 has been shifted gradually becomes larger than the output from the other secondary coil, resulting in the outputs becoming imbalanced. Thus, in the present embodiment, the shifting width W is set to 1.5 mm to 3.0 mm.

Figure 4:
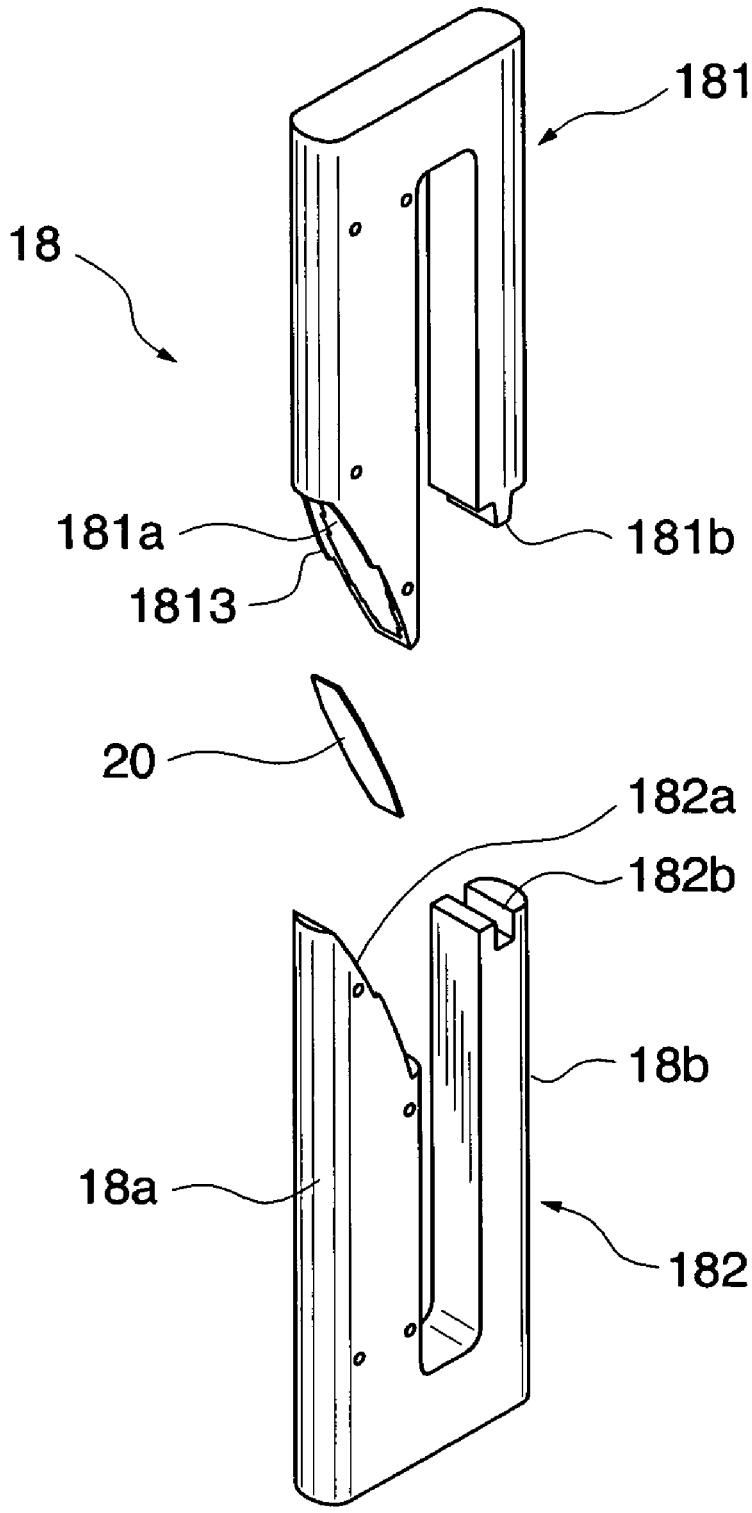
FIG. 4 is a perspective view showing a core as a constructional member of the coil assembly.

Next, a description will be given of the core 18 as the constructional member of the coil assembly 10. FIG. 4 is a perspective view showing the core 18 as the constructional member of the coil assembly 10.

As shown in FIG. 4, the core 18 is comprised of two core members 181 and 182 that are substantially square U-shaped. By combining the core members 181 and 182 together, for example, a closed magnetic path that is rectangular in frontal view is formed.

One joint portion of the core members 181 and 182 is an inclined joint portion that is inclined at a predetermined angle such as 10 to 20 degrees to the joining direction, i.e. the vertical direction as viewed in FIG. 4. That is, the core members 181 and 182 have inclined joint surfaces 181*a* and 182*a*, respectively. A plate-shaped permanent magnet 20 is interposed between the inclined joint surfaces 181*a* and 182*a*. Thus, a magnetic flux passing through the core 18 is reverse-biased, resulting in increased secondary output.

Examples of joint portions other than the above-mentioned one joint portion include a joint where concave and convex surfaces are joined together. The core member 181 has, for example, a convex joint surface 181*b*, and the core member 182 has, for example, a concave joint surface 182*b*.

The most part of surfaces of the core members 181 and 182 is coated with mold resin. For example, insulating polypropylene resin is used as the mold resin.

The mold resin 1813 around the inclined joint surfaces 181*a* and 182*a* of the core members 181 and 182 partially projects out from the inclined joint surfaces 181*a* and 182*a* by a predetermined height, that is, a height corresponding to the thickness of the magnet 20, for example, about 0.5 mm to 2.0 mm. When the core members 181 and 182 are combined together, the projecting mold resin 1813 covers the total circumferences of the inclined joint surfaces 181*a* and 182*a*, and a housing space for the magnet 20 which is enclosed by the inclined joint surfaces 181*a* and 182*a* and the projecting mold resin 1813 is formed.

Figure 5:
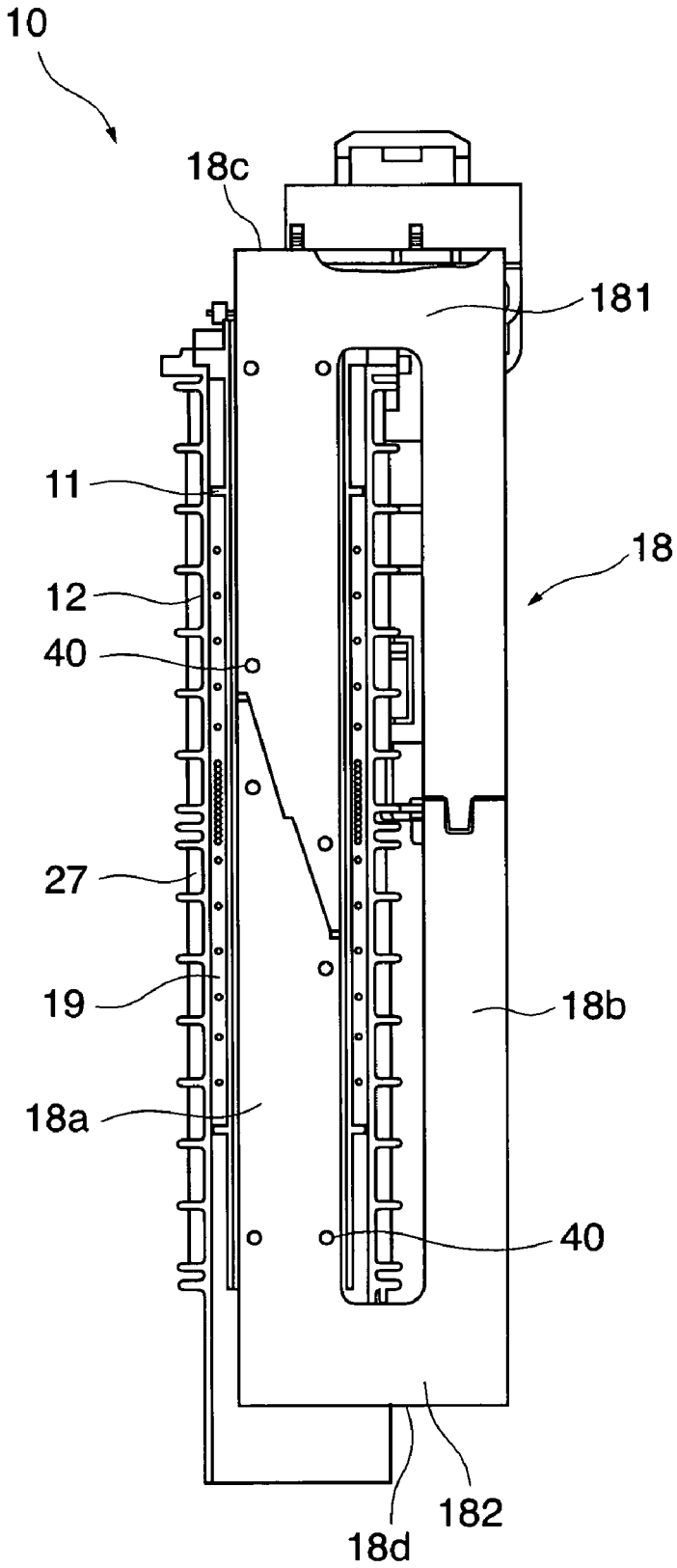
FIG. 5 is a view useful in explaining the coil assembly of which core is inserted into a central space of a coil pair.

FIG. 5 is a view useful in explaining the coil assembly 10 in which the above described core 18 is fitted into a central space of the coil pair. It should be noted that in FIG. 5, the coil pair is illustrated in a sectional view, but the core 18 is illustrated in a frontal view for the convenience of explanation.

As shown in FIG. 5, the primary coil 19 is wound around the primary coil bobbin 11, and the secondary coils 27 are wound around the secondary coil bobbin 12. The diameter of the secondary coil bobbin 12 is larger than that of the primary coil bobbin 11, and the secondary coil bobbin 12 is disposed outside and concentrically with the primary coil bobbin 11. The primary coil 19 and the secondary coils 27 form the pair of coils that are concentrically arranged.

The core 18 is an assembly comprised of a combination of the core members 181 and 182. The core 18 that forms the closed magnetic path is formed by interposing the magnet 20 between the inclined joint surface 181*a* of the core member 181 and the inclined joint surface 182*a* of the core member 182 and joining the convex joint surface 181*b* of the core member 181 and the concave joint surface 182*b* of the core member 182 together (see FIG. 4).

A center core 18*a* that is part of the core 18 is fitted into the central space of the coil pair, that is, the central space of the primary coil bobbin 11 as the coil supporting member, and a side core 18*b* parallel to the center core 18*a* is disposed along an outer surface of the secondary coil bobbin 12 as the constructional member of the coil pair. Because the core 18 is constructed as an assembly of the core members 181 and 182, assembly in fitting part of the core 18 into the central space of the coil assembly 10 is easy.

Moreover, because the core 18 is comprised of the center core 18*a* and the side core 18*b*, and the closed magnetic path is formed by the center core 18*a* and the side core 18*b*, the magnetic flux does not leak and thus can be effectively used, and hence a decrease in output from the secondary coils 27 can be prevented.

In the ignition coil according to the present embodiment, pin marks that are formed on a mold resin coating when the core members 181 and 182 constructing the core 18 are coated with mold resin are further filled with insulating resin so as to reduce projections and depressions on the surface of the mold resin coating.

When the core members are insert-molded, that is, when the core members are coated with mold resin, marks of holding pins that hold the core members in molds are left as concave portions on the surface of the mold resin, and insulating resin as a hardened casting material in the ignition coil may be cracked due to the concave portions. To solve this problem, in the present embodiment, once the core members have been coated with the mold resin, the second molding for example is carried out in which the concave portions on the surface of the mold resin coating are filled with mold resin so as to eliminate the pin marks formed during the coating and prevent cracking.

In the ignition coil according to the present embodiment, a plurality of projections 40 as guide ribs for positioning a surface of the center core 18*a* with respect to an inner wall surface of the primary coil bobbin 11 are provided on the surface of the center core 18*a* of the core 18 (see FIG. 5). The projections 40 have the same height and project out from the surface of the center core 18*a* by, for example, 0.05 mm to 0.6 mm. The distal ends of the respective projections 40 abut on the inner wall surface of the primary coil bobbin 11.

It is preferred that the projections 40 are disposed at regular intervals, for example, in the longitudinal direction and the outer circumferential direction of the center core 18*a*. Thus, the gap between the inner wall surface of the primary coil bobbin 11 and the surface of the center core 18*a* can be made uniform, and the surface of the center core 18*a* can be accurately positioned with respect to the inner wall surface of the primary coil bobbin 11. The projections 40 as the guide ribs can be molded at the same time in the resin molding step, for example.

In the ignition coil according to the present embodiment, one end of the core 18 that forms the closed magnetic path is coated with an elastic member.

One end of the core 18, for example, an end of the core 18 that is located at an opening end of the housing 1 (an upper end as viewed in FIG. 1) when the coil assembly 10 is fitted into the housing 1 has a magnetic material exposed because of insert molding. If the casting material is injected with the magnetic material exposed portion left as it is, in the case where, for example, a directional silicon steel sheet is used for the core 18, the casting material strongly presses down a C-end 18*c* (see FIG. 5) of the directional silicon steel sheet after the casting material is hardened, and hence, for example, predetermined secondary output cannot be obtained due to magnetostriction which is not negligible. Thus, in the present embodiment, a D-end 18*d* (see FIG. 5) of the core 18 is coated with insulating resin by insert molding, and the above described magnetic material exposed end (C-end) 18*c* of the core 18 is coated with an elastic member.

In this case, it is preferred that, for example, the mold resin 1813 (see FIG. 4) that coats the circumference of the end face of the core 18 is raised by a predetermined height, for example, 1 mm to 2 mm from the magnetic material exposed end face so as to form a peripheral wall surrounding the magnetic material exposed end face so that the end face of the core 18 can be the bottom surface of the concave portion. The elastic member is then disposed in the concave portion surrounded by the mold resin and thermally caulked by the mold resin 1813, for example.

A foamed sponge made of silicon rubber is suitably used as the elastic member. In this case, it is preferred that the foamed sponge as the elastic member is provided with through holes penetrating therethrough in the direction of thickness. This enables a void and a casting material to be smoothly passed through the foamed sponge during injection of the casting material.

In the present embodiment, the coil assembly 10 is fitted into the housing 1 having the cut portion 3 with which the H/T tower 4 is engaged so as to engage the connector 15 with the cut portion 2, one secondary output terminal 23 is joined to the H/T tower 4, the plug cap 7 having the spring 6 therein is engaged with one end (lower end as viewed in FIG. 1) of the housing 1 as a connector for the other secondary output terminal 22, and insulating resin is filled into the gap between the housing 1 as the coil case and the coil assembly 10 and the gaps which the coil assembly 10 has, in other words, the gaps between the constructional members, so that the ignition coil is constructed. The ignition coil is fixed at a predetermined location of the engine block, and one secondary output terminal 22 is mounted on a plug hole of an engine and directly connected to one ignition plug engaged with the plug cap 7 mounted on, for example, a lower end of the housing 1. The other secondary output terminal 23 is mounted on the other ignition plug disposed in the same cylinder via the high-tension cord. The ignition coil thus acts as an engine ignition source that outputs balanced secondary output voltages.

According to the present embodiment, because the center 19*a* of the primary coil 19 is shifted toward the secondary coil 27*b* of the two secondary coils 27*a* and 27*b*, which is connected to the other ignition coil in the same cylinder via the high tension cord, the binding coefficient Kb of the primary coil 19 and the secondary coil 27*b* is made to be greater than the binding coefficient Ka of the primary coil 19 and the secondary coil 27*a*, so that a decrease in output caused by an increase in floating capacitance due to the high tension cord can be compensated for, and hence the two secondary outputs can be balanced.

In the present embodiment, the intermediate tap 17 that is the center of the winding width of the secondary coils 27 may be connected to the anode of the diode 16, and the cathode of the diode 16 may be connected to the ground of the battery. This makes it possible to reliably maintain the terminal at the center of the secondary coils at a low potential and obtain stable secondary output. Also, at the time of switching of the primary coil, electric discharge of the ignition plugs caused by a rise in ON-current flowing through the primary coil for the first time can be prevented.

In the present embodiment, the primary coil 19 of the coil assembly 10 may be comprised of at least two coils connected in parallel to each other, and one ends of the at least two primary coils may be connected to the anodes of respective corresponding diodes, and the cathodes of the respective diodes may be connected together. This makes it possible to stabilize secondary output, in particular secondary output in a low-speed range even if the parallel-connected two coils are used as the primary coils. By using the parallel-connected two coils as the primary coils, direct-current resistance of the primary coils can be reduced, and hence as compared with other types of ignition coils using a primary coil having approximately the same number of turns, primary electric current in a low-speed range increases, and secondary voltage can be made more stable.

Next, a detailed description will be given of a second embodiment of the present invention with reference to the drawings.

Figure 6:
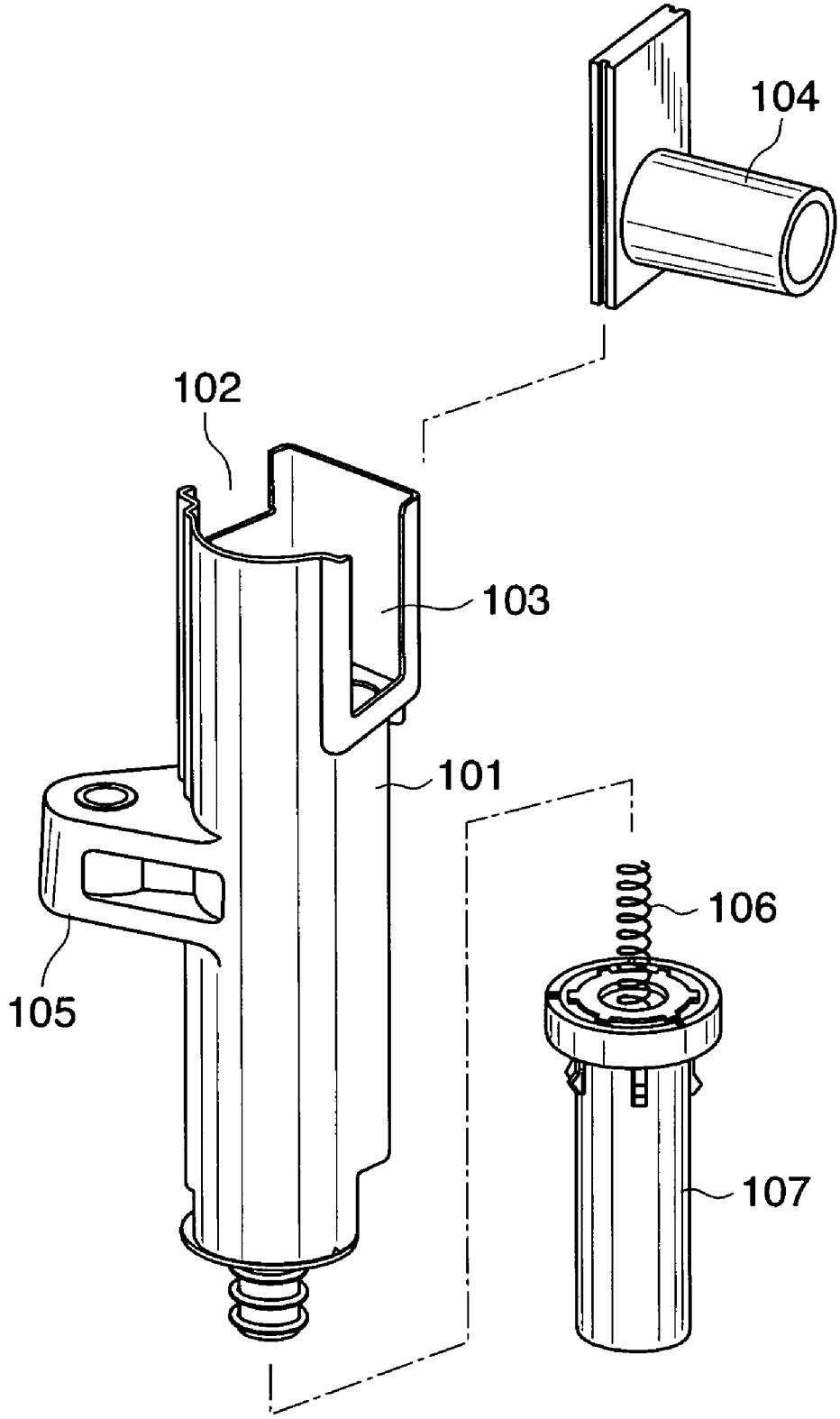
FIG. 6 is an assembly diagram showing a coil case applied to an ignition coil according to another embodiment of the present invention.
Figure 7:
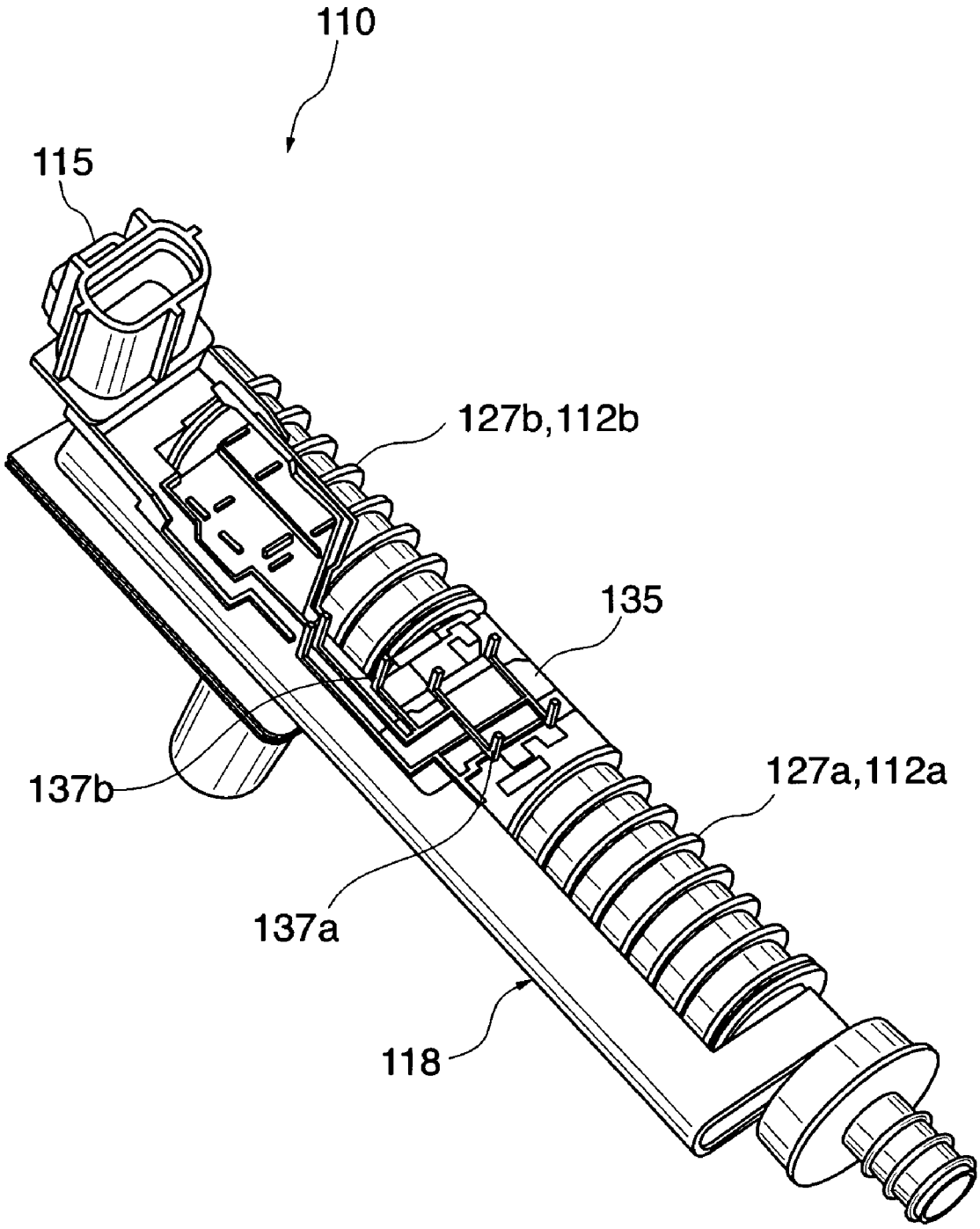
FIG. 7 is a perspective view showing a coil assembly fitted into the coil case in FIG. 6.

FIG. 6 is an assembly diagram showing a coil case applied to an ignition coil for an internal combustion engine according to the second embodiment, and FIG. 7 is a perspective view showing a coil assembly fitted into the coil case in FIG. 6. The ignition coil according to the present embodiment is of a dual ignition type having two secondary output terminals, and is comprised mainly of a housing 101 as the coil case in FIG. 6, and a coil assembly 110 in FIG. 7 fitted into the housing 101.

As shown in FIG. 6, a cut portion 102 with which a connector 115 (see FIGS. 7 and 8 referred to later) that supports primary terminals of the coil assembly is to be engaged is provided at an opening end of an upper portion of the housing 101. A cut portion 103 with which a high-tension (H/T) tower 104 as a take-out end for secondary output from the coil assembly is to be engaged is provided such as to face the cut portion 102 across the central axis of the housing 101. Moreover, a mounting flange 105 for fixing the ignition coil to, for example, an engine block of a vehicle is provided on an outer surface of the housing 101, and a plug cap 107 having a spring 106 therein is engaged with a lower end of the housing 101 as viewed in FIG. 6.

As shown in FIG. 7, the coil assembly 110 is comprised of a secondary coil bobbin 112*a* around which a secondary coil 127*a* is wound, a secondary coil bobbin 112*b* around which a secondary coil 127*b* is wound, and two primary coil bobbins that are disposed inside and concentrically with the secondary coil bobbins 112*a* and 112*b* and around which respective primary coils are wound. The two primary coils and the secondary coils 127*a* and 127*b* form respective pairs of coils (the primary side is not shown in FIG. 7; see FIG. 11 or 12). A substrate 135 is provided between the secondary coil bobbins 112*a* and 112*b*. It should be noted that the secondary coil bobbins 112*a* and 112*b* and the two primary coil bobbins are made of, for example, modified PPO (polyphenylene oxide) resin.

Part of a core 118 that forms a closed magnetic path is inserted such as to be fitted into central spaces of the coil pairs. The coil assembly 110 is thus comprised mainly of the coil pairs comprised of the secondary coils 127*a* and 127*b* and the two primary coils (not shown), and the core 118 part of which is fitted into the central spaces of the coil pairs. Secondary low-voltage terminals 137*a* and 137*b* of the secondary coils 127*a* and 127*b* are fixed on the substrate 135.

Figure 8:
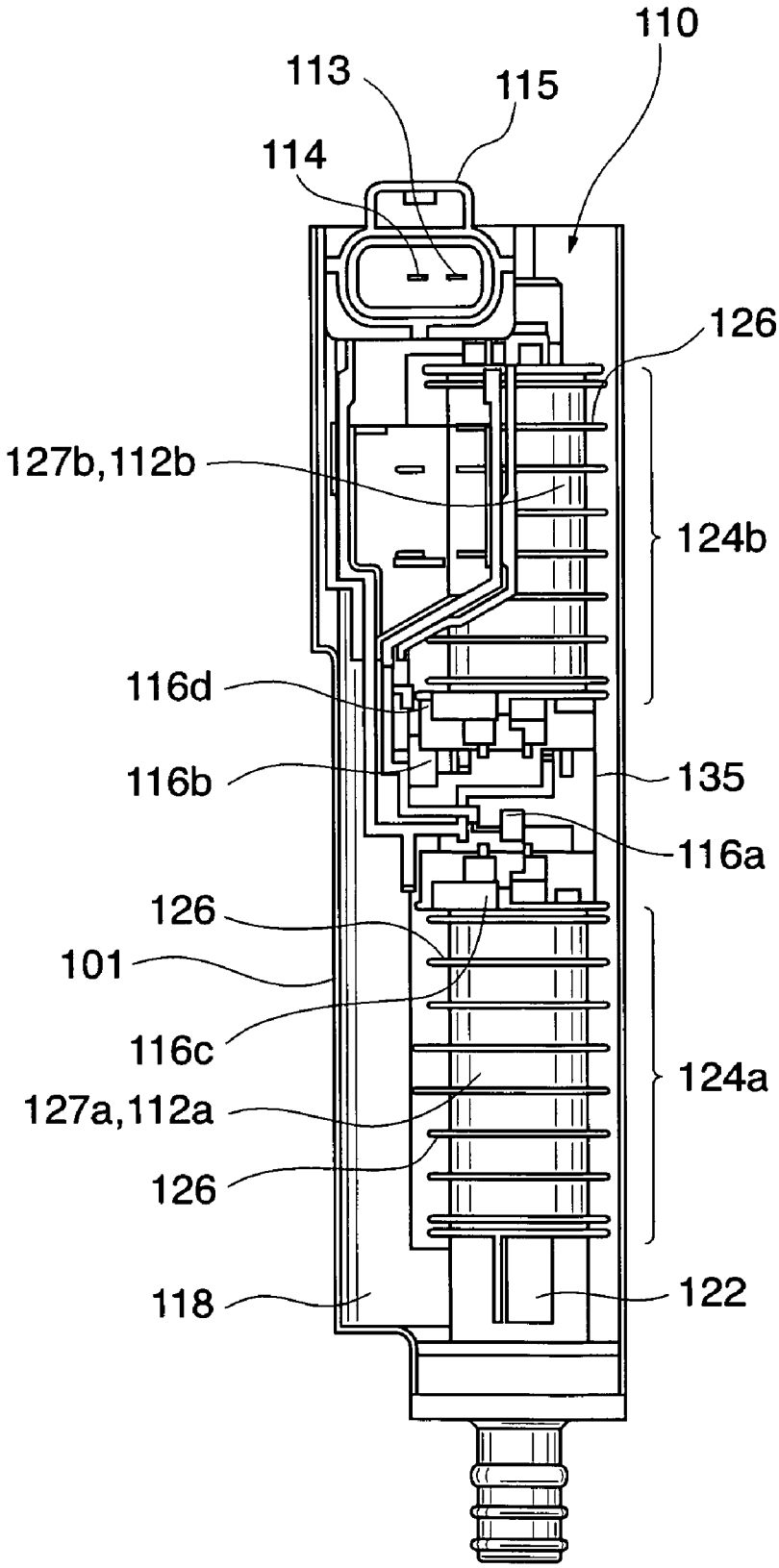
FIG. 8 is a view useful in explaining the ignition coil in a state in which with the coil assembly in FIG. 7 is engaged with a housing.

FIG. 8 is a view useful in explaining a state in which the coil assembly 110 is engaged with the housing 101.

As shown in FIG. 8, outer surfaces of the secondary coil bobbins 112*a* and 112*b* are winding areas 124*a* and 124*b*, respectively, around which the respective secondary coils are wound. Each of the winding areas 124*a* and 124*b* is partitioned at regular intervals by a plurality of partition plates 126 extended in the direction of the normal to outer peripheral surfaces. The secondary coils are wound in opposite directions (reversely wound) around the first winding area 124*a* and the second winding area 124*b*, so that the two secondary coils 127*a* and 127*b* wound in opposite directions are formed.

The connector 115 that is substantially L-shaped is engaged with one end of the coil assembly 110, i.e. an upper end of the coil assembly 110 as viewed in FIG. 8, and primary terminals 113 and 114 are insert-molded in the connector 115. The ends of winding of the two primary coils are connected to the primary terminal 114 by fusing or the like. The starts of winding of the two primary coils are connected to the anodes of respective corresponding diodes 116*a* and 116*b*, and the cathodes of the diodes 116*a* and 116*b* are connected to the primary terminal 113 by fusing or the like. The primary terminal 113 is connected to a collector 136 (see FIG. 12) of a transistor of a control circuit (not shown). The diodes 116*a* and 116*b* are fixed on the substrate 135.

The low-voltage side ends as the starts of winding of the secondary coils 127*a* and 127*b* wound in opposite directions with the substrate 135 being a boundary are connected to the anodes of respective corresponding diodes 116*c* and 116*d* (other diodes). The cathodes of the diodes 116*c* and 116*d* are connected on the substrate 135 to the primary terminal 113 (see FIG. 12). The diodes 116*c* and 116*d* are fixed on the substrate 135.

The end of winding of the secondary coil 127*a* is connected by fusing or the like to an end of the coil assembly 110, for example, the secondary output terminal 122 provided on the secondary coil bobbin 112*a* at a lower end of the coil assembly 110 as viewed in FIG. 8. The secondary output terminal 122 is directly connected to one ignition plug via the coil cap 106 (see FIGS. 6 and 7).

On the other hand, the end of winding of the secondary coil 127*b* is connected by fusing or the like to an end of the coil assembly 110, for example, the secondary output terminal 123 (not shown) provided on the secondary coil bobbin 112*b* at an opening end of an upper portion of the coil assembly 110. The secondary output terminal 123 is connected to the other ignition plug in the same cylinder via the H/T tower 104 (see FIG. 6) and a high tension cord.

Arbitrary ones of the partition plates 126 on the secondary coil bobbins 112*a* and 112*b* shown in FIG. 8 are constructed as ribbed partition plates that have at outer peripheral ends thereof a plurality of guide ribs for positioning an outer surface of the coil assembly 110 with respect to an inner wall surface of the housing 101 with a predetermined space left therebetween.

Figure 9:
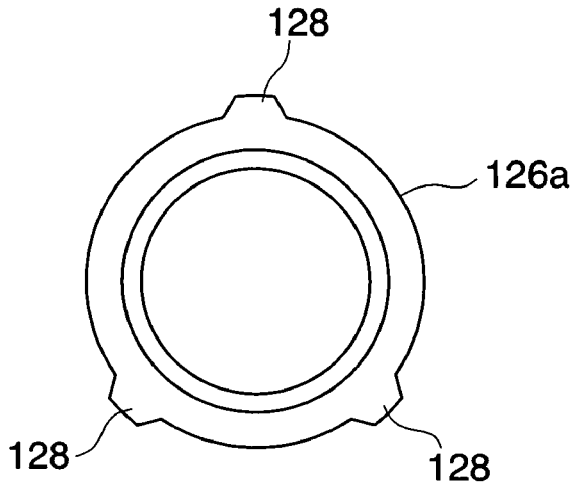
FIG. 9 is a plan view showing a ribbed partition plate.

FIG. 9 is a plan view showing the ribbed partition plate. As shown in FIG. 9, a plurality of, i.e. three in the drawing, guide ribs 128 as projections are provided on an outer peripheral portion of the ribbed partition plate 126*a*. The intervals at which the guide ribs 128 are disposed on one ribbed partition plate 126*a* should not necessarily be equal, but the guide ribs 128 and the ribbed partition plates 126*a* are preferably disposed or provided such that the guide ribs 128 are disposed at regular intervals on an outer surface of the secondary coil bobbin 112. As a result, the gap between the secondary coil bobbins 112 (112*a* and 112*b*), and by extension the coil assembly 110 and the inner wall surface of the housing 101 can be maintained uniform, and the coil assembly 110 can be accurately positioned with respect to the inner wall surface of the housing 101. Moreover, stress in insulating resin can be made uniform, and hence cracking can be prevented.

In the present embodiment, a limited area in which no guide rib 128 is provided is formed on a surface of the secondary coil bobbin 112 which faces the mounting flange 105 on an outer surface of the housing 101 across the wall of the housing 101 when the coil assembly 110 constructed using the secondary coil bobbins 112 (112*a* and 112*b*) is fitted into the housing 101. Thus, cracking caused by distortion on at joints of insulating resin as a hardened casting material and guide ribs can be prevented.

Figure 10:
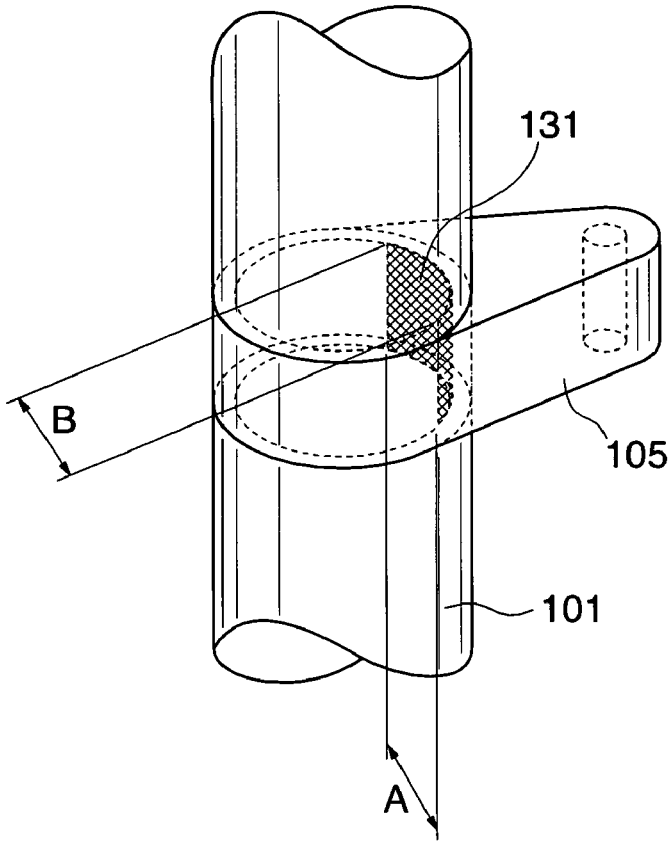
FIG. 10 is a view useful in explaining a limited area in which no guide rib is provided.

FIG. 10 is a view useful in explaining the limited area in which no guide rib is provided. As shown in FIG. 10, the limited area is a surface area of the secondary coil bobbin (not shown) which faces an area 131 defined by the horizontal maximum width A of the mounting flange 105 mounted on the housing 101 and the vertical maximum thickness B of the mounting flange 105, or is an area including and larger than the surface area. Because there is the limited area in which no guide rib is provided on the surface of the secondary coil bobbin, stress acting on joints of the guide ribs 128 and the insulating resin that is the hardened casting material can be reduced when the ignition coil is fixed at the engine block, and hence cracking can be prevented.

Figure 11:
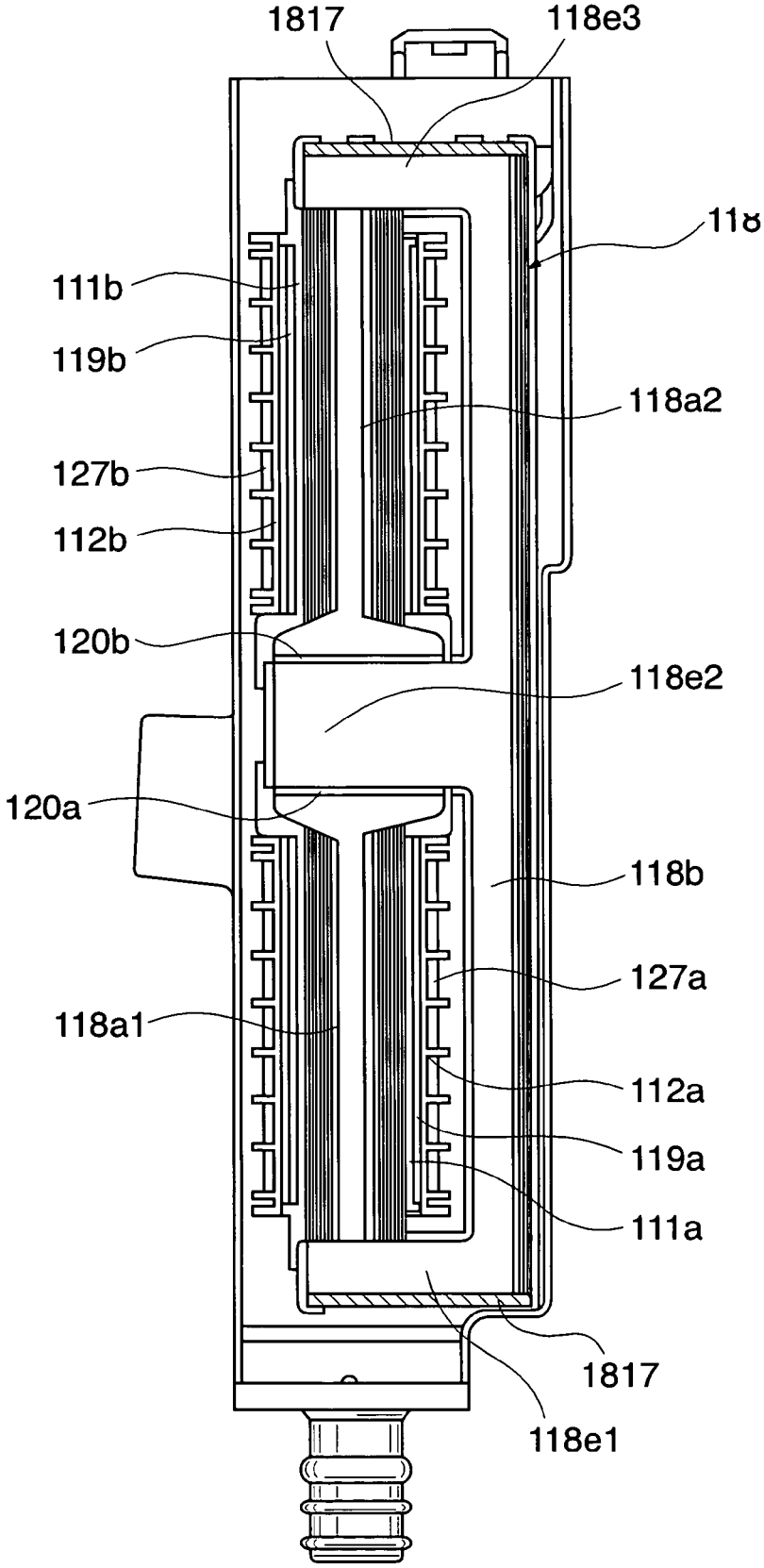
FIG. 11 is a longitudinal sectional view showing the ignition coil in FIG. 8.

FIG. 11 is a longitudinal sectional view showing the ignition coil in FIG. 8.

As shown in FIG. 11, the primary coil 119*a* is wound around the primary coil bobbin 111*a*, and the primary coil 119*b* is wound around the primary coil bobbin 111*b*. On the other hand, the secondary coil 127*a* is wound around the secondary coil bobbin 112*a*, and the secondary coil 127*b* is wound around the secondary coil bobbin 112*b*. The primary coils 119*a* and 119*b* and the secondary coils 127*a* and 127*b* form the respective pairs of coils that are concentrically arranged.

The primary coils 119*a* and 119*b* are wound in opposite directions and connected in parallel to each other. The secondary coils 127*a* and 127*b* are wound in opposite directions and connected in series to each other. Center cores 118*a*1 and 118*a*2 as part of the core 118 that forms the magnetic path is fitted into the central spaces of the coil pairs comprised of the primary coils 119*a* and 119*b* and the secondary coils 127*a* and 127*b*. In the following description of the present embodiment, an E-shaped core is used as a side core of a closed magnetic path core, but if a common magnetic path (118*e*2) between the adjacent primary coils is not used as in the case of an open magnetic path of an I-shaped core or a closed magnetic path of a square-shaped core, the primary coils 119*a* and 119*b* are wound in the same direction and connected in parallel to each other.

The core 118 that forms the closed magnetic path is comprised mainly of the center cores 118*a*1 and 118*a*2 as core members obtained by dividing above and below the core into two as viewed in FIG. 11, and a side core 118*b* having a side core main body provided parallel to the center cores 118*a*1 and 118*a*2. The side core 118*b* has three extended portions 118*e*1 to 118*e*3 that extend in a direction at right angles to the side core main body toward the center cores 118*a*1 and 118*a*2 so as to connect to a lower end of the center core 118*a*1, a joint portion of the center cores 118*a*1 and 118*a*2, and an upper end of the center core 118*a*2, respectively. The side core 118*b* is E-shaped (or inverted E-shaped) in frontal view. A magnetic flux produced in the primary coil 119*a* into which the center core 118*a*1 is fitted forms one closed loop with, for example, the center core 118*a*1, the extended portion 118*e*1, the side core 118*b*, and the extended portion 118*e*2 as the common magnetic path, and a magnetic flux produced in the primary coil 119*b* forms one closed loop with the center core 118*a*2, the extended portion 118*e*3, the side core 118*b*, and the extended portion 118*e*2 as the common magnetic path. However, because the primary coils 119*a* and 119*b* are wound in opposite directions and connected in parallel to each other as described above, the magnetic fluxes flow in the same direction in the extended portion 118*e*2 as the common magnetic path, so that predetermined secondary output can be obtained without collision of the magnetic fluxes.

Upper and lower end faces of the E-shaped side core 118*b* as viewed in FIG. 11 are coated with elastic members 1817. This aims at absorbing a change in the actual dimensions of the side core 118*b* due to magnetostriction or thermal distortion and preventing cracking of insulating resin that is a hardened casting material (such as thermosetting epoxy resin) filled into gaps between the constructional members. Moreover, coating or disposing the elastic members 1817 on the upper and lower end faces of the side core 118*b* is particularly useful because deterioration of magnetic property caused by magnetostriction can be prevented in the case where a directional silicon steel sheet is used for the core 118.

The E-shaped side core 118*b* is coated with mold resin (not shown) comprised of thin-walled insulating resin, and the elastic members 1817 coating the above-mentioned upper end lower end faces of the E-shaped side core 118*b* are surrounded by the mold resin. Thus, the elastic members 1817 are supported or fixed in a stable manner. By coating the side core 118*b* with the mold resin, stress produced through direct contact of the side core 118*b* and the insulating resin as the casting material is reduced, and hence the insulating resin is prevented from being cracked.

Plate-shaped permanent magnets (hereinafter referred to merely as the "magnets") 120*a* and 120*b* are provided on contact surfaces between ends of the center cores 118*a*1 and 118*a*2 on the joint side and the extended portion 118*e*2 extended from the side core 118*b*. Because there are the magnets 120*a* and 120*b*, the magnetic fluxes flowing through the center cores 118*a*1 and 118*a*2 are reverse-biased, resulting in increased secondary output.

By inserting the E-shaped side core 118*b* into the coil pairs with the center cores 118*a*1 and 118*a*2 fitted therein from the side thereof, the primary coil bobbins 111*a* and 111*b*, the secondary coil bobbins 112*a* and 112*b*, the center cores 118*a*1 and 118*a*2, and the magnets 120*a* and 120*b* are fixed at predetermined locations, so that the coil assembly 110 having the core 118 forming the closed magnetic path is formed.

Figure 12:
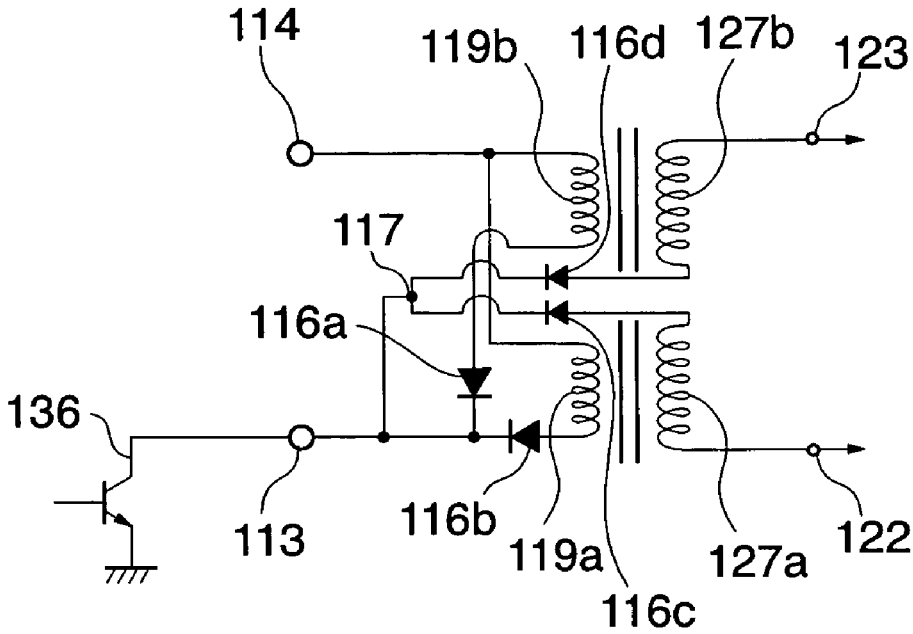
FIG. 12 is a connection wiring diagram showing the ignition coil in FIG. 11.

FIG. 12 is a connection wiring diagram showing the ignition coil in FIG. 11.

As shown in FIG. 12, inner ends of the secondary coils 127*a* and 127*b*, which are wound in opposite directions, as the starts of winding are connected to the anodes of the respective corresponding diodes 116*c* and 116*d*, and the cathodes of the diodes 116*c* and 116*d* are connected together at a midpoint P117 and then connected to the collector 136 of, for example, a transistor of a control circuit via the primary terminal 113. On the other hand, the ends of winding of the secondary coils 127*a* and 127*b* are connected to the secondary output terminals 122 and 123, respectively.

Ground-side ends of the primary coils 119*a* and 119*b*, which are connected in parallel to each other, as the starts of winding are connected to the anodes of the respective corresponding diodes 116*a* and 116*b*, and the cathodes of the diodes 116*a* and 116*b* are connected to the collector 136 of the transistor constituting part of the control circuit (not shown) via the primary terminal 113. The control circuit controls, for example, electric current flowing through the primary coils 119*a* and 119*b*. On the other hand, the ends of winding of the primary coils 119*a* and 119*b* are connected to the primary terminal 114. By connecting the primary coils 119*a* and 119*b* in parallel to each other, direct-current resistance of the primary coils 119*a* and 119*b* is reduced, and hence as compared with other types of ignition coils using a primary coil having approximately the same number of turns, primary electric current in a low-speed range increases, and secondary voltage can be made more stable.

Moreover, by connecting the diodes 116*a* and 116*b* in series to the respective primary coils 119*a* and 119*b*, decrease in secondary output caused interference of the two primary coils 119*a* and 119*b* can be prevented.

In the ignition coil according to the present embodiment, the center cores 118*a*1 and 118*b*2 and the side core 118*b* are coated with mold resin. When they are insert-molded using mold resin, pin marks formed on the mold resin coating are left as concave portions, and as a result, the insulating resin may become distorted and cracked. It is thus preferred that the pin marks formed during primary molding are further filled with insulating resin so as to reduce projections and depressions on the surface of the mold resin coating.

In the ignition coil according to the present embodiment, it is preferred that projections as guide ribs for positioning surfaces of the center cores 118*a*1 and 118*a*2 with respect to inner wall surfaces of the primary coil bobbins 111*a* and 111*b* are provided on surfaces of the center cores 118*a*1 and 118*a*2. The projections are provided at regular intervals, for example, in the longitudinal direction and the outer circumferential direction of the core 118 and have the same height, for example, about 0.05 mm to 0.6 mm. Because the projections are provided as guide ribs, the gap between the inner wall surfaces of the primary coil bobbins 111*a* and 111*b* and the surfaces of the center cores 118*a*1 and 118*a*2 can be made uniform, and the surfaces of the center cores 118*a*1 and 118*a*2 can be accurately positioned with respect to the inner wall surfaces of the primary coil bobbins 111*a* and 111*b*. The projections as guide ribs can be molded at the same time in the resin molding step, for example.

In the present embodiment, the coil assembly 110 is fitted into the housing 101 having the cut portion 103 with which the H/T tower 104 is engaged so as to engage the connector 115 of the coil assembly 110 with the cut portion 102, one secondary output terminal 123 is joined to the H/T tower 104, the plug cap 107 having the spring 106 therein is engaged with one end (a lower end as viewed in FIG. 6) of the housing 101 as a connector for the other secondary output terminal 122, and insulating resin is filled into gaps between the constructional members, so that the ignition coil is constructed.

The ignition coil is fixed at a predetermined location of the engine block, and the secondary output terminal 122 is mounted on a plug hole of an engine and directly connected to one ignition plug mounted on, for example, a lower end of the housing 101. The secondary output terminal 123 is mounted on the other ignition plug disposed in the same cylinder via the high-tension cord. The ignition coil thus acts as an engine ignition source.

According to the present embodiment, because the primary coils are comprised of the primary coils 119*a* and 119*b* that are connected in parallel to each other, and the corresponding diodes are connected to the respective starts of winding of the primary coils 119*a* and 119*b*, stable secondary output can be obtained while avoiding interference of the primary coils 119*a* and 119*b*, and in particular secondary output in a low-speed range can be made stable. Moreover, because the two secondary coils 127*a* and 127*b* are wound in opposite directions, stable outputs of the same polarity can be obtained.

Although in the present embodiment, the two primary coils 119*a* and 119*b* are connected in parallel to each other, the present invention is not limited to this, but three or more primary coils may be connected in parallel to each other. In this case, corresponding diodes are connected to the respective parallel-connected three or more primary coils.

Although in the present embodiment, the low-voltage side ends of the secondary coils 127*a* and 127*b* are connected to the anodes of the respective corresponding diodes, the same effects can be obtained if the low-voltage side ends of the secondary coils 127*a* and 127*b* are connected together at a midpoint P and then the joint thereof is connected to the anode of one diode.

Figure 13:
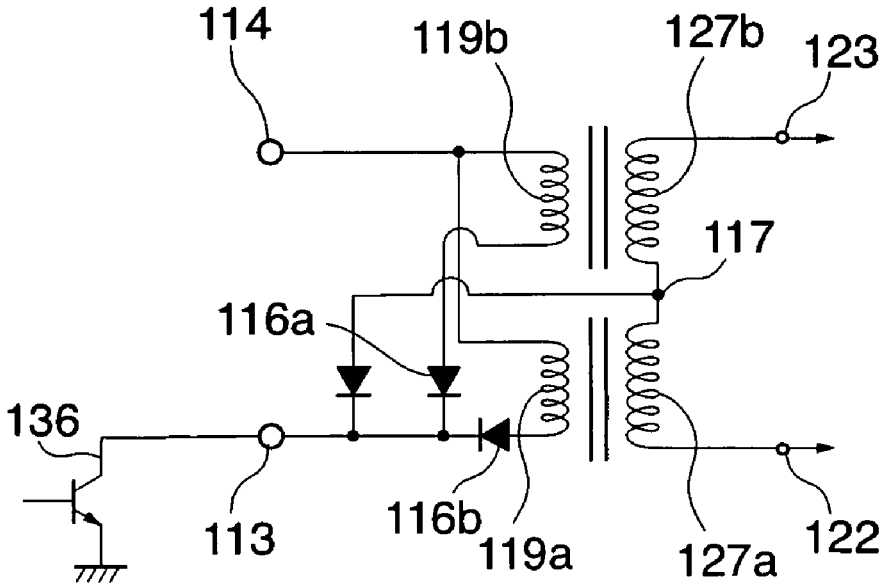
FIG. 13 is a connection wiring diagram showing a variation of the ignition coil in FIG. 11.
Figure 14:
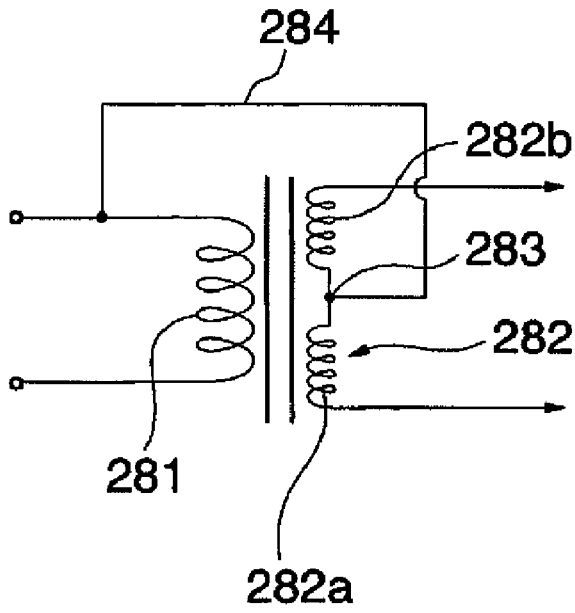
FIG. 14 Prior Art
FIG. 14 is a connection wiring diagram showing a conventional ignition coil of a dual ignition type.
Figure 15:
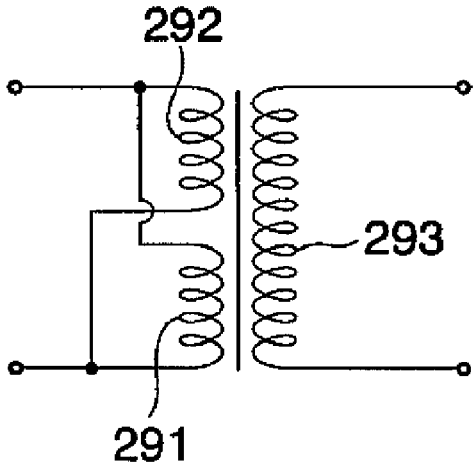
FIG. 15 Prior Art
FIG. 15 is a connection wiring diagram showing a conventional ignition coil.

FIG. 13 is a connection wiring diagram showing a variation of the ignition coil according to the present embodiment. As shown in FIG. 13, two secondary coils 127*a* and 127*b* are connected together at a midpoint P 117, the midpoint P 117 is connected to the anode of a diode other than diodes connected to primary coils, and the cathode of the diode to which the midpoint P117 is connected is connected to a collector 136 of, for example, a transistor of a control circuit via a primary terminal 113. In this case as well, the same effects as those in the above described embodiment can be obtained.

Further, in the present embodiment, if it is possible to use a single bobbin as in the case of an open magnetic path of an I-shaped core or a closed magnetic path of a square-shaped core, the same effects as those in the above described embodiment can be obtained by winding one continuous winding material right-handed (left-handed) from one end of the bobbin toward a midpoint P, winding the winding material left-handed (right-handed) from the midpoint P toward the other end of the bobbin, and connecting the anode of a diode to a terminal provided at the midpoint P.

What is claimed is:

1. An ignition coil of a dual ignition type comprising:

a coil case;

a coil assembly housed in said coil case; and a casting material configured to fill a gap between said coil case and said coil assembly and gaps in said coil assembly, wherein said coil assembly has a coil pair comprising a primary coil and two secondary coils disposed concentrically with said primary coil, the two secondary coils of the coil pair being wound in opposite directions with a center of winding width of the two secondary coils with respect to the longitudinal direction of the primary coil defining a boundary, a center of winding width of the primary coil with respect to the longitudinal direction thereof being shifted from the boundary of the secondary coils by a predetermined width so as to balance outputs from the two secondary coils, an output end of one of the two secondary coils being directly connected to a first ignition plug arranged in a first cylinder, and an output end of the other of the two secondary coils being connected via a high tension cord to a second ignition plug arranged in the first cylinder, and the center of winding width of the primary coil, with respect to the longitudinal direction of the primary coil, being shifted by the predetermined width toward the secondary coil connected to the second ignition plug, wherein the shifting width is 1.5 mm to 3.0 mm.

2. The ignition coil as claimed in claim 1, wherein a terminal is provided at the center of winding width of the two secondary coils and connected to a positive electrode or a ground of a battery.

3. The ignition coil as claimed in claim 2, wherein the terminal at the center of winding width of the two secondary coils is connected to an anode of a diode, and a cathode of the diode is connected to the positive electrode or the ground of the battery.

4. The ignition coil as claimed in claim 1, wherein:

a core that forms a magnetic path is fitted into a central space of the coil pair, the core forms a closed magnetic path having a center core and a side core, and the center core is fitted into the central space of the coil pair.

5. The ignition coil as claimed in claim 1, wherein said casting material comprises insulating resin.

6. The ignition coil as claimed in claim 1, wherein the primary coil of the coil pair comprises at least two coils that are connected in parallel to each other, and respective ends of the at least two primary coils are connected to anodes of respective corresponding diodes, and cathodes of the respective diodes are connected together.

7. The ignition coil as claimed in claim 1, wherein a binding coefficient of the other of the two secondary coils and the primary coil is greater than a binding coefficient of the one of the secondary coils directly connected to the first ignition plug and the primary coil, whereby a decrease in output caused by a floating capacitance of the high tension cord is compensated.

* * * * *

UNITED STATES PATENT AND TRADEMARK OFFICE

CERTIFICATE OF CORRECTION

PATENT NO. : 7,796,004 B2
APPLICATION NO. : 12/150159
DATED : September 14, 2010
INVENTOR(S) : Shuichi Matsubayashi It is certified that error appears in the above-identified patent and that said Letters Patent is hereby corrected as shown below:

Item (30) Foreign Application Priority Data, should read:

--Apr. 27, 2007 (Japan) 2007-119212

Apr. 27, 2007 (Japan) 2007-119215--

Signed and Sealed this
Thirty-first Day of January, 2012

David J. Kappos

David J. Kappos
*Director of the United States Patent and Trademark Office*